US007267719B2

(12) United States Patent
Lunden et al.

(10) Patent No.: US 7,267,719 B2
(45) Date of Patent: Sep. 11, 2007

(54) USE OF COLLOIDAL PCC

(75) Inventors: Klaus Akilles Lunden, Kökkedal (DK); Ib Attrup, Greve (DK); Jens Toftelund Madsen, Søborg (DK)

(73) Assignee: J.M. Huber Corporation, Edison, NJ (US)

( * ) Notice: Subject to any disclaimer, the term of this patent is extended or adjusted under 35 U.S.C. 154(b) by 327 days.

(21) Appl. No.: 11/009,740

(22) Filed: Dec. 10, 2004

(65) Prior Publication Data

US 2005/0098066 A1 May 12, 2005

(30) Foreign Application Priority Data

May 27, 1998 (DK) ..... 1998 00735

(51) Int. Cl.
*C09C 1/02* (2006.01)

(52) U.S. Cl. ..... 106/464; 106/465

(58) Field of Classification Search ..... 106/464, 106/465; 423/430–432
See application file for complete search history.

(56) References Cited

U.S. PATENT DOCUMENTS

| | | | | |
|---|---|---|---|---|
| 3,304,154 | A * | 2/1967 | Kiouzes-Pezas | 423/432 |
| 4,026,762 | A * | 5/1977 | Bauman | 162/181.2 |
| 4,167,423 | A * | 9/1979 | Williams | 106/431 |
| 4,892,590 | A * | 1/1990 | Gill et al. | 106/217.01 |
| 5,120,365 | A * | 6/1992 | Kogler | 106/415 |
| 5,164,006 | A * | 11/1992 | Chapnerkar et al. | 106/465 |
| 5,489,471 | A * | 2/1996 | Inoue et al. | 428/304.4 |
| 5,695,733 | A * | 12/1997 | Kroc et al. | 423/432 |
| 5,879,442 | A * | 3/1999 | Nishiguchi et al. | 106/464 |
| 6,623,555 | B1 * | 9/2003 | Haverinen et al. | 106/465 |

* cited by examiner

*Primary Examiner*—J. A. Lorengo
*Assistant Examiner*—Patricia L. Hailey
(74) *Attorney, Agent, or Firm*—Carlos Nieves; William Parks

(57) ABSTRACT

The invention relates to a process for regulating the porosity and printing properties of paper, in particular uncoated wood-containing paper such as SC-paper, wherein a sufficient quantity of colloidal PCC having a BET surface area of 10-100 $m^2/g$ is used as a filler in the paper to achieve a desired porosity of the paper; as well as paper containing colloidal PCC as filler, and a pigment mixture suitable for paper manufacture and containing colloidal PCC.

12 Claims, 2 Drawing Sheets

USE OF COLLOIDAL PCC

CROSS-REFERENCE TO RELATED APPLICATIONS

This is a divisional of U.S. application Ser. No. 09/701,261, filed Nov. 27, 2000, now U.S. Pat. No. 6,887,351 the content of which is incorporated herein by reference in its entirety for all purposes.

FIELD OF THE INVENTION

The invention relates to use of colloidal PCC (precipitated calcium carbonate) as a filler in the preparation of paper for the purpose of controlling the porosity and printing properties of the paper.

BACKGROUND OF THE INVENTION

In the connection with the manufacture of paper it is very important to be able to control the porosity of the paper. For example, a paper with low porosity is required in order to obtain an acceptable result in, e.g., ink-jet and rotogravure printing. If the paper is too porous it will function like blotting paper during printing and the resulting print may appear blurred, the contrast between printed and unprinted areas or between differently coloured areas not being rendered sharply. Similarly, on a paper which is of non-uniform porosity it can be seen that the intensity of colouration varies ("mottling"), which is of course undesirable since the coloured surface appears variegated or mottled. On the other hand, the porosity of the paper can also be too low, since a very dense paper will have difficulty in absorbing printing ink, which among other things may result in smudging ("set off") between printed sheets. This phenomenon can influence the printing results, the printing speed and the printing process employed in a negative manner.

The paper industry presently uses several different ways of regulating the porosity of paper. Use is made among other things of the fact that certain minerals in the form of flakes, e.g. talc and kaolin, will, as result of their form, be able to reduce the porosity since the individual particles will become deposited like the scales on a fish and thereby seal the surface. Fine silicates can be used in connection with pigmentation to reduce the porosity of the paper. When they come into or onto the paper, these fine particles will close the pores which contribute to the porosity of the paper.

In order to regulate the properties of the paper, a combination of one or more fillers and a variety of other additives is often used. Among the group of additives are alkylketene dimers (AKD), alkenylsuccinic acid anhydride (ASA), starch and retention agents. Retention agents are added to facilitate the manufacture of the paper, whilst AKD, ASA and starch are added to ensure the quality of the paper (strength, printing properties, etc.).

Regardless of which of the presently known methods is used, they all have drawbacks. Kaolin and talc in the form of flakes will negatively influence the brightness of the paper compared to the whiter fillers, such as ground marble or PCC (precipitated calcium carbonate).

The fine silicate products used for pigmentation have relatively good technical properties. However, the silicate products have the disadvantage of being much more expensive than the fillers normally used in paper manufacture. The same applies to other additives normally used in connection with paper manufacture. These are often many times more expensive than a calcium carbonate filler.

Over the years, numerous attempts have been made to optimize paper compositions precisely for the purpose of improving the porosity and printing properties of the paper. The problem has been, however, that none of these approaches to a solution have been ideal, since they have either had a negative influence on the other properties of the paper (among other things the brightness) or are relatively expensive to use (silicate products).

The use of colloidal PCC as such in paper is known. For example, U.S. Pat. No. 4,892,590 discloses the use of a two-component binder system as a retention agent for paper manufacture, wherein the binder comprises colloidal PCC with a high specific surface area together with a cationic starch. The PCC used has a surface area of 10-200 $m^2/g$, and the weight ratio between PCC and cationic starch is from 2:1 to 1:20.

U.S. Pat. No. 4,460,637 discloses ink-jet paper (coated paper) with 2 different peaks of pore size distribution in the ink-receiving layer or layers. The desired pore size distribution can be achieved, interalia by means of agglomerates with an average diameter of 1-50 μm in which the individual particles in the agglomerates have a size of at most 0.20 μm, e.g. colloidal particles of at most 0.01 μm; such colloidal particles can be colloidal calcium carbonate.

It is not believed that colloidal PCC has previously been described or used as a filler in paper for the purpose of controlling the porosity and printing properties of the paper.

DESCRIPTION OF THE INVENTION

Figure 1:
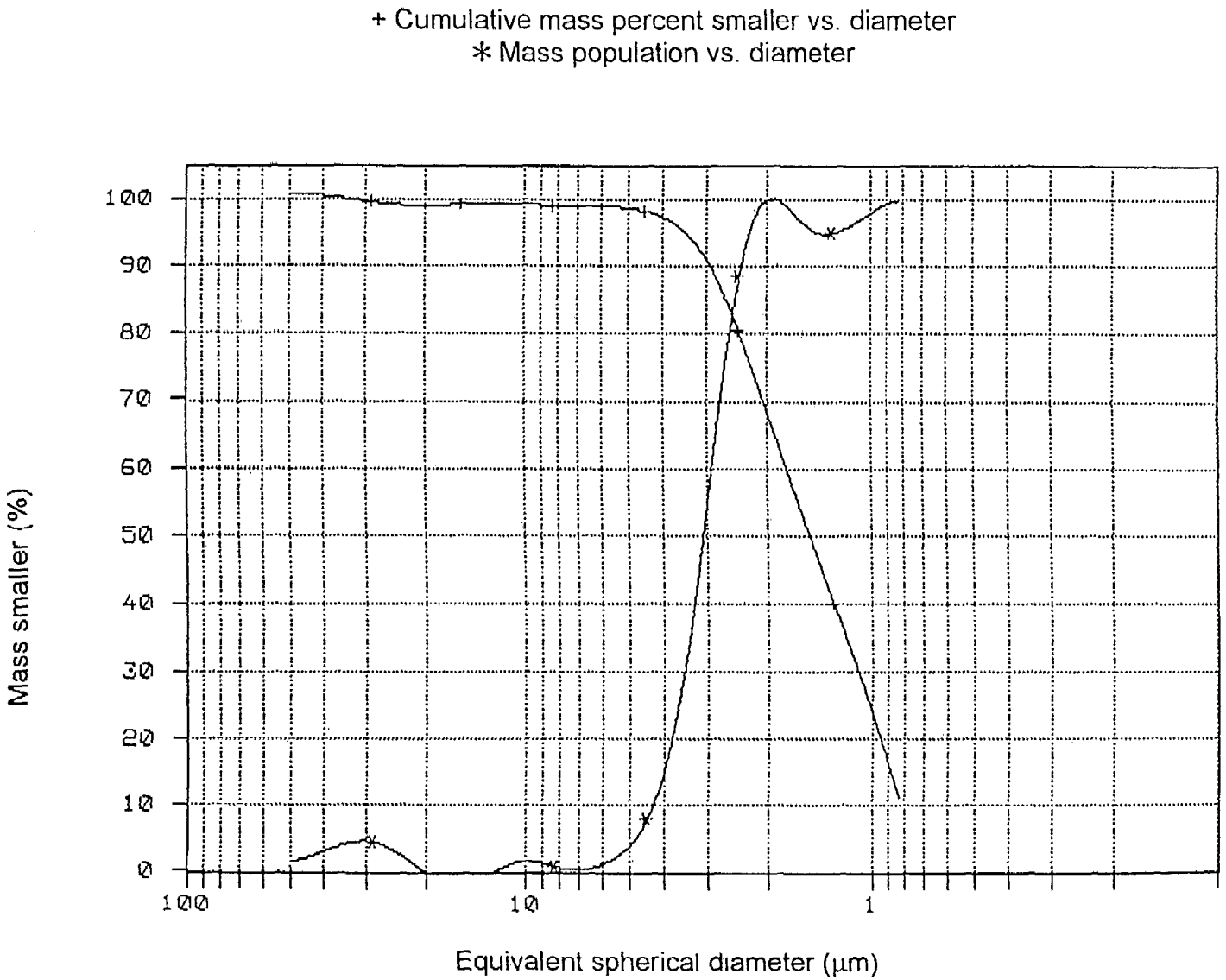
FIG. 1 is a graphical representation of the particle size distribution of an inventive colloidal PCC product.

It has now been found that use of colloidal PCC with a large surface area as a filler makes it possible to replace a proportion of the previously mentioned pigments whilst also providing the possibility of regulating the porosity and printability properties of the paper. Compared with the previously described methods, the use of colloidal PCC has numerous advantages. It is cheap, produces low wear, it can produce greater brightness than kaolin and talc flakes, and the product is more adaptable to individual types of paper.

In its broadest aspect, the present invention relates to the use of colloidal PCC as a filler to control the porosity and printing properties of paper, in particular to reduce the porosity relative to the porosity which can otherwise be achieved with other types of fillers and pigments conventionally used in the manufacture of paper.

One aspect of the invention thus relates to a process for regulating the porosity and printing properties of paper, wherein a sufficient quantity of colloidal PCC having a BET surface area of 10-100 $m^2/g$ is used as a filler to achieve a desired porosity of the paper.

In another aspect, the invention relates to paper containing colloidal PCC as a filler.

In a third aspect, the invention relates to a pigment mixture which is suitable for manufacture of paper and which contains colloidal PCC.

Other aspects and preferred embodiments will be apparent from the following detailed description of the invention.

As employed in the present description and claims, the term "colloidal PCC" (chemical formula: $CaCO_3$) designates a PCC product in the form of aggregates/agglomerates of individual PCC particles in which the aggregates/agglomerates have a surface area of at least 10 $m^2/g$ as determined by the BET method (Brunauer, Emmet, Teler, DIN 66131). The aggregates/agglomerates preferably have an equivalent spherical particle size (median particle size, MPS) in the range about 0.1-5.0 μm, e.g. about 0.2-4 μm, typically about 0.5-3.0 μm, as determined e.g. by sedimentation on a Sedigraph 5100 from Micromeritics. The aggregates'/agglomerates' BET surface area will typically be up to about 100 $m^2/g$, more typically up to about 80 $m^2/g$, e.g. up to about 50 $m^2/g$,.e.g. up to about 30 $m^2/g$ and typically at least about 15 $m^2/g$, e.g. at least about 20 $m^2/g$. The aggregates/agglomerates consist of a greater or smaller number of single crystals having an equivalent spherical particle size of, typically, about 0.01-0.50 μm.

It will be apparent to the skilled person that colloidal PCC can also occur as aggregates with a surface area of less than 10 $m^2/g$, but as mentioned above the expression "colloidal PCC" in the context of the present application is to be understood as PCC with the stated surface area of at least 10 $m^2/g$. Correspondingly, according to the present invention a PCC mixture in which a part of the mixture is colloidal PCC with a surface area of at least 10 $m^2/g$ and a part of the mixture is "non-colloidal PCC" can be used, "non-colloidal PCC" being defined as PCC with a surface area of less than 10 $m^2/g$.

An example of a colloidal PCC product according to the invention is given in the table below:

| Parameter | Value |
|---|---|
| Median particle size, MPS (μm) | 1.5 |
| Brightness ($R_{457}$-ISO, %) | 95.8 |
| Surface area (BET, $m^2/g$) | 25.0 |

Figure 2:
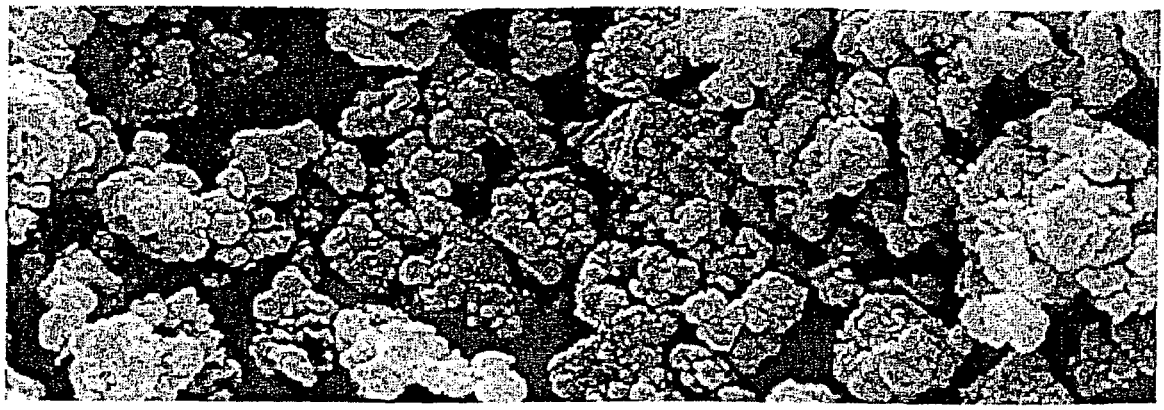
FIG. 2 is a pictorial representation of a scanning electron microscope (SEM) view of the aggregates of the inventive POC product.

The particle size distribution of this PCC product is shown in FIG. 1, whilst FIG. 2 shows a SEM picture of typical aggregates.

The colloidal PCC can, if desired, be used alone, i.e. as sole filler or pigment, in the manufacture of paper, but will presumably normally be used with at least one further filler or pigment. These further fillers and pigments can be selected among both non-colloidal PCC and other types of fillers. There is a wide variety of types of PCC with different crystal forms which are suited as a filler, e.g. scalenohedral PCC, rhombohedral PCC, needle-shaped PCC (aragonite) and spherical PCC (vaterite). Among other types of fillers and pigments which are suited for incorporation in paper, the following can be named: kaolin, calcined kaolin, talc, gypsum, ground marble, aluminium silicate, calcium silicate, magnesium silicate and other silicate-containing minerals, calcium sulphate, barium sulphate, titanium dioxide, zinc oxide, zinc carbonate, calcium sulfoaluminates (satin white), aluminium hydroxide, diatomaceous earth, plastic particles and organic pigments. Paper manufactured, according to the present invention can, in addition to the colloidal PCC, suitably contain one or more such PCC or non-PCC fillers or pigments to obtain the desired paper properties. Preferred further fillers are non-colloidal PCC, kaolin, calcined kaolin, talc, gypsum, chalk, ground marble, silicate-containing minerals and calcium sulfoaluminates. Non-colloidal PCC, kaolin, calcined kaolin, chalk and ground marble are particularly preferred.

The finding which forms the basis of the invention, namely the fact that the porosity of paper can be regulated accurately by means of colloidal PCC, provides the advantage, however, that the relative amount of the colloidal PCC relative to other fillers and/or pigments, as well as the colloidal PCC's properties (especially the surface area), can be adjusted in each individual case in order to achieve the properties which are desired for the paper in question. It is thus clear that the amount of colloidal PCC which is to be used depends on the type of paper to be manufactured and on the type and amount of any other fillers. The amount of colloidal PCC to be used can therefore vary widely, i.e. from about 1% by weight of the total filler up to 100% of the total filler. The colloidal PCC will normally be used in an amount of at least 10% by weight, more typically at least 20% by weight, e.g. at least about 50% by weight, based on the weight of the total filler. The precise amount of colloidal PCC to be used in order to achieve the desired properties for a given paper, including a particular porosity, will be easily determined by the skilled person, e.g. by simply preparing a series of paper samples in which there are used different amounts of the colloidal PCC relative to the other fillers.

Typically, the amount of colloidal PCC used according to the invention will be at least about 1% by weight based on the total weight of the paper, more typically at least about 2% by weight, e.g. at least about 3% by weight, such as at least about 4% or 5% by weight. Depending on the total amount of filler in the paper and the proportion of the filler that is comprised by the colloidal PCC, the colloidal PCC can of course be present in significantly higher amounts, however.

According to the invention, the colloidal PCC can be used as a filler to regulate the porosity and printing properties of any type of paper, including e.g. wood-containing paper such as super-calendered (SC) paper/newsprint and wood-free paper such as fine paper. The invention is particularly suited for regulating the porosity and printing properties of uncoated paper, more particularly uncoated wood-containing paper, since these properties can be difficult to regulate in such paper compared to coated paper, where the porosity is controlled by the coating layer. In a preferred embodiment, the invention relates to the use of the colloidal PCC in the preparation of SC paper.

It will be known to persons skilled in the art of paper manufacturing that the terms "wood-containing" and "wood-free" refer to whether or not the lignin component of the ligno-cellulose wood fibres has been removed. These terms are used herein in accordance with their conventional meanings in the art, i.e. "wood-free" refers to cellulose fibres in which substantially all or at least most of the lignin has been removed, whereas "wood-containing" refers to ligno-cellulose fibres in which the lignin component has not been removed. While the specific amount of lignin that can be present in "wood-free" pulp may vary from country to country, this amount is relatively small. For example, in Finland wood-free paper is defined as paper in which less than 10% by weight of the pulp is groundwood or other lignin-containing pulp. In the present context, "wood-containing paper" thus refers to paper in which the fibres comprise a substantial lignin component, wherein typically at least about 5% by weight of the pulp is lignin-containing pulp, more typically at least about 10% by weight, such as at least about 15 or 20% by weight.

Removal of lignin to result in wood-free fibres can performed by means of various well-known processes, e.g. using the Kraft process or by sulphite pulping. Such processes that remove lignin from the wood fibres result in higher quality, but also more expensive fibres.

In the case of SC paper, in particular SC-A paper, containing colloidal PCC according to the invention, the porosity can e.g. be reduced to a value of at most about 0.30 μm/Pas, e.g. at most about 0.28 μm/Pas, e.g. at most about 0.26 μM/Pas, e.g. at most about 0.24 μM/Pas, e.g. at most about 0.22 μM/Pas. In other words, the porosity of the paper can be reduced to a value around, or possibly even lower than, the value of the porosity of an equivalent paper prepared on the basis of kaolin; this is illustrated in Example 1.

The present invention also allows improved porosity values in SC-B paper. Thus, SC-B paper containing colloidal PCC according to the invention may have a porosity of at most about 0.60 μm/Pas, e.g. at most about 0.50 μm/Pas, e.g. at most about 0.40 μm/Pas, e.g. at most about 0.35 μm/Pas.

It will be known to persons skilled in the art that SC paper may be classified into one of several subcategories based on properties of brightness, filler level, roughness, sheet gloss and porosity. The top grade of SC paper is thus SC-A+. SC-A paper typically differs from SC-A+ in having a somewhat lower brightness, while SC-B typically differs from SC-A in having one or more of a lower brightness, a lower filler level, a lower sheet gloss and a higher porosity.

In the context of the present specification and claims, the SC paper grades SC-A, SC-A+ and SC-B are defined as follows.

SC-A

Brightness≧64%

Filler level≧30%

Roughness (0.5 bar)≦2.0 μm

Roughness (1 bar)≦1.5 μm

Porosity≦0.3 μm/Pas

SC-A+

As SC-A above, but brightness≧70%

SC-B

SC papers that do not fulfil the requirements for SC-A, but which fulfil the following requirements:

Brightness≧60%

Filler level≧15%

Roughness (0.5 bar)≦3.0 μm

Roughness (1 bar)>2.5 μm

Porosity≦0.6 μm/Pas

In the case of newsprint, the use of colloidal PCC according to the invention will make it possible to reduce the porosity of the paper to a value of at most about 20 μM/Pas, e.g. at most about 18 μM/Pas, e.g. at most about 16 μM/Pas; this is illustrated in Example 2. For SC paper, newsprint and other types of paper the porosity achieved in each case will depend among other things on the pulp used and on the amount and properties of the colloidal PCC and any other fillers used. The above mentioned porosity values for SC paper and newsprint, respectively, are therefore only to be taken as examples, the important feature of the invention being the possibility of regulating (reducing) the porosity relative to the porosity which would otherwise be achievable in a given paper using a filler according to the prior art.

Colloidal PCC can be prepared in a known manner by carbonating milk of lime (calcium hydroxide slurry) under suitable conditions. The following conditions are to be regarded as a non-limiting example of the preparation of colloidal PCC:

Burnt lime having a reactivity (DIN $T_{60}$) of between 10 sec. and 5 min. is slaked in 40° C. warm water using a water/lime ratio of 4:1. The thus-prepared milk of lime is diluted to 40% dry matter content, after which it is screened through a 500 μm screen.

After screening, the milk of lime is cooled to 20° C. and carbonated in an appropriate gas flow reactor using flue gas or a $CO_2$-air mixture typically containing 20% $CO_2$. Carbonation is continued until the pH has fallen below 8.

At a gas flow of 2.5 $m^3$ flue gas per $m^3$ reactor volume the reaction will occur over a period of about 3 hours. After carbonation is completed the colloidal PCC is screened through a 45 μm screen.

The invention is further illustrated by the following non-limiting examples.

In the examples below, the following standards were used for determining paper properties:

| | |
|---|---|
| Gram weight: | Scan-P 6:75 |
| Thickness: | Scan-P 7:96 |
| Density: | Scan-P 7:96 |
| Gloss: | Tappi T480 om-92 |
| Brightness: | ISO 2470 |
| Opacity: | ISO 2471 |
| Roughness: | Scan-P 76:95 |
| Porosity: | PPS method |

All amounts are by weight unless otherwise indicated.

EXAMPLE 1

Regulation of Porosity in SC Paper

The following pigments were tested in SC paper:

| | Kaolin reference Filler - M (ECC International) | Rhombohedral PCC Standard product (Faxe Paper Pigments A/S) | Colloidal PCC Experimental product (Faxe Paper Pigments A/S) |
|---|---|---|---|
| Brightness ($R_{457}$-ISO, %) | 78.9 | 97.0 | 95.9 |
| MPS (μm) | 3.3 | 1.8 | 1.1 |
| BET ($m^2/g$) | 9.0 | 6.2 | 25 |

The test was carried out on a pilot paper machine with filler levels of 27, 30 and 33%.

The fibers were of Scandinavian origin and consisted of:

| | |
|---|---|
| TMP (thermomechanical pulp) and GW (groundwood) | 85% |
| Kraft (cellulose fibers processed by the "kraft" process) | 15% |

The following chemicals were used in the manufacturing process:

| | |
|---|---|
| Retention agent | none |
| Other | none |

pH adjusted to 7.3 by addition of $H_3PO_4$.

For comparison purposes the results for paper are interpolated to 30% filler after calendering. The results are shown in the table below.

| | Kaolin reference | Rhombohedral PCC | Colloidal PCC |
|---|---|---|---|
| Gram weight (g/m$^2$) | 55 | 56 | 56 |
| Thickness (μm) | 49 | 54 | 55 |
| Density (g/m$^2$) | 1.123 | 1.030 | 1.020 |
| Gloss (75°, %) | 35 | 32 | 36 |
| Brightness ($R_{457}$-ISO, %) | 69.6 | 76.3 | 72.5 |
| Opacity (%) | 86.8 | 90.0 | 85.9 |
| Roughness (μm) | 1.48 | 1.48 | 1.46 |
| Porosity μm/Pas | 0.19 | 0.32 | 0.21 |

It can be seen from the above table that colloidal PCC surprisingly is capable of lowering the porosity of the paper from 0.32 μm/Pas using a standard PCC to 0.21 μm/Pas with colloidal PCC, which is on a par with the kaolin reference.

EXAMPLE 2

Reduction of Porosity of Newsprint Using Colloidal PCC as Filler

The following pigments were tested in newsprint:

| | Reference Calcined Kaolin (Ansilex from Engelhard) | Faxe Chalk 89 Chalk (Faxe Kridt A/S) | Rhombohedral PCC (Faxe Paper Pigments A/S) | Colloidal PCC Experimental product (Faxe Paper Pigments A/S) |
|---|---|---|---|---|
| Brightness ($R_{457}$-ISO, %) | 89.6 | 87.4 | 96.2 | 95.7 |
| MPS (μm) | 0.9 | 1.5 | 1.2 | 1.1 |
| BET (m$^2$/g) | 15.0 | 3.2 | 9.2 | 23.0 |

The test was carried out on a pilot paper machine with filler levels from 2-10%.

The fibres consisted of:

| | |
|---|---|
| Unbleached TMP (thermomechanical pulp) | 95% |
| Bleached cellulose prepared by the sulphate process | 5% |

The following chemicals were used in the preparation:

| | |
|---|---|
| Retention agent | Percol 230 L (cationic polyacrylamide from Allied Colloids) |
| Other | none |

pH adjusted to 7.3 by addition af $H_2SO_4$.

For comparison purposes the results for paper are interpolated to 4% filler. The results are given in the following table, the gram weight of the papers being 46 g/m$^2$.

| | Reference Calcined Kaolin (Ansilex from Engelhard) | Faxe Chalk 89 Chalk (Faxe Kridt A/S) | Rhombohedral PCC (Faxe Paper Pigments A/S) | Colloidal PCC Experimental product (Faxe Paper PigmentsA/S) |
|---|---|---|---|---|
| Thickness (μm) | 106 | 106 | 105 | 105 |
| Roughness (μm) | 5.2 | 6.2 | 6.2 | 6.2 |
| Porosity (μm/Pas) | 17 | 21 | 20 | 15 |
| Brightness ($R_{457}$-ISO, %) | 63.5 | 61.1 | 61.6 | 60.5 |
| Opacity (%) | 90.2 | 89.4 | 89.8 | 90.6 |

It can be seen from the table above that colloidal PCC surprisingly is able to lower the porosity of the paper from 21 μm/Pas with a standard PCC to 15 μm/Pas with colloidal PCC, which is lower than the kaolin reference at 4% filler level.

CONCLUSION

By using colloidal PCC as filler the porosity of the paper is lowered significantly. The amount of colloidal PCC in the paper can thereby be varied as required, so that the porosity and thereby also the printing properties can be regulated precisely. The colloidal PCC can thus be used as required instead of or in combination with other conventional fillers and pigments in order to achieve the desired porosity.

EXAMPLE 3

A pigment mixture consisting of 50 parts (by weight) fine scalenohedral PCC, 30 parts fine rhombohedral PCC and 20 parts colloidal PCC was tested in production scale as a filler in SC-A grade paper at a commercial paper mill. The PCC pigment mixture was pH-stabilised by addition of a small amount of phosphoric acid in order to avoid the need for acid addition on the paper machine for pH-control. The properties of the PCC mixture and the reference clay filler used in the trial are listed in the table below.

| | Reference kaolin clay (European filler grade) | Experimental PCC mixture (Faxe Paper Pigments A/S) |
|---|---|---|
| Brightness ($R_{457}$-ISO %) | 79.2 | 94.1 |
| MPS (μm) | 1.38 | 1.62 |
| BET surface area (m$^2$/g) | 11.7 | 10.8 |

The pulp furnish composition was 50 parts deinked pulp (DIP), 40-45 parts groundwood (GW) and 5-10 parts Kraft pulp.

The trial PCC mixture was tested at a constant total filler level with two levels of PCC addition. The balance to give the total amount of filler is reference clay and filler introduced with the DIP (recycled paper).

The properties of the papers resulting from the trial are listed in the table below.

| | Reference | Trial 1 | Trial 2 |
|---|---|---|---|
| Added PCC[1] | 0% | 10% | 20% |
| Added clay[1] | 32% | 22% | 12% |

-continued

| | Reference | Trial 1 | Trial 2 |
|---|---|---|---|
| Analysed $CaCO_3$ content[1] | 1.5% | 13.4% | 24.2% |
| Analysed clay content[1] | 37.6% | 25.6% | 15.2% |
| Gram weight | 57 g/m$^2$ | 56 g/m$^2$ | 56 g/m$^2$ |
| Roughness TS (0.5 bar) | 1.70 μm | 1.75 μm | 1.65 μm |
| Roughness WS (0.5 bar) | 1.70 μm | 1.70 μm | 1.55 μm |
| Porosity (PPS)[2] | 0.122 μm/Pa · s | 0.197 μm/Pa · s | 0.228 μm/Pa · s |
| Gloss 75°, TS MD | 50% | 45% | 45% |
| Gloss 75°, WS MD | 48% | 49% | 49% |
| Brightness $R_{457}$-ISO | 66.4% | 70.1% | 72.1% |
| Opacity | 92.1% | 92.5% | 91.8% |

[1]By weight, based on the total weight of paper;
TS = topside;
WS = wireside;
MD = machine direction
[2]PPS = Parker-Print-Surf method The runnability of the paper machine remained good during the two-day trial period and it was possible to increase the production capacity by 1.5%. The Hydrocol™ two-component retention system was used on the paper machine. The amount of cationic polymer could be reduced during the trial as the PCC pigment mixture was easier to retain than the reference clay. The pH in the paper machine headbox was 7.4 prior to the trial and it increased only slightly (to 7.6) during the trial.

The paper produced during the trial showed excellent results in fill-scale commercial printing. It is remarkable that the paper brightness has been increased by 6 percentage points without any loss in opacity. The resulting 72% brightness is close to the superior SC-A+ quality.

EXAMPLE 4

A pigment mixture consisting of 80 parts (by weight) fine rhombohedral PCC and 20 parts colloidal PCC was tested in production scale as a filler in SC-B grade paper at a commercial paper mill. The rhombohedral PCC and the colloid PCC had BET surface areas of approximately 7 and 20 m$^2$/g, respectively, to provide a mixture having an overall BET surface area of 9.1 m$^2$/g as indicated below. The PCC pigment mixture was pH-stabilised by addition of a small amount of phosphoric acid in order to avoid the need for acid addition on the paper machine for pH-control. The properties of the PCC mixture and the reference fillers used in the trial are listed in the table below.

| Filler: | Reference kaolin clay (European filler grade) | Reference PCC | Experimental PCC mixture (Faxe Paper Pigments A/S) |
|---|---|---|---|
| Brightness ($R_{457}$-ISO %) | 76.6 | 96.2 | 95.4 |
| MPS (μm) | 2.13 | 1.70 | 1.31 |
| BET (m$^2$/g) | 11.9 | 8.6 | 9.1 |

The pulp furnish composition was 30-35 parts deinked pulp (DIP), 10-15 parts chemothermomechanical pulp (CTMP) and groundwood (GW), adding up to a total of 100 parts.

The trial PCC mixture was tested at a constant total filler level with two levels of PCC addition. The balance to give the total amount of filler is reference clay and filler introduced with the DIP (recycled paper).

The properties of the papers resulting from the trial are listed in the table below.

| | Reference | Trial 1 | Trial 2 |
|---|---|---|---|
| Added Faxe PCC[1] | 0% | 11% | 18% |
| Added reference PCC[1] | 11% | 0% | 0% |
| Added clay[1] | 11% | 11% | 4% |
| Analysed $CaCO_3$ content[1] | 15.8% | 14.8% | 22.4% |
| Analysed clay content[1] | 17.8% | 17.4% | 11.2% |
| Gram weight | 57 g/m$^2$ | 56 g/m$^2$ | 56 g/m$^2$ |
| Roughness TS (0.5 bar) | 2.80 μm | 2.90 μm | 2.90 μm |
| Roughness WS (0.5 bar) | 2.60 μm | 2.80 μm | 2.80 μm |
| Porosity (PPS) | 0.570 μm/Pa · s | 0.514 μm/Pa · s | 0.554 μm/Pa · s |
| Gloss 75°, TS MD | 27% | 27% | 26% |
| Gloss 75°, WS MD | 24% | 25% | 24% |
| Brightness $R_{457}$-ISO | 63.4% | 62.6% | 64.8% |
| Opacity | 96.4% | 95.9% | 96.0% |

[1]By weight, based on the total weight of paper;
TS = topside;
WS = wireside;
MD = machine direction.

The runnability of the paper machine remained good during the two-day trial period and it was possible to increase the production capacity by 1.3%. The Hydrocol™ two-component retention system was used on the paper machine. The amount of cationic polymer could be reduced during the trial, as the PCC pigment mixture was easier to retain than the reference clay. The amount of blue and yellow colour could be reduced as well. The pH in the paper machine headbox was 7.3 prior to the trial and it was stable at 7.2±0.1 during the trial.

The paper produced during the trial showed excellent results in full-scale commercial printing. The pulp bleaching was reduced in order to keep the paper brightness within the production specifications. The reduced amount of bleaching chemicals is an advantageous cost saving for the paper mill and environmentally beneficial.

EXAMPLE 5

A pigment mixture consisting of 80 parts (by weight) fine rhombohedral PCC and 20 parts colloidal PCC was tested in production scale as a filler in SC-A grade paper at a commercial paper mill. The PCC pigment mixture was pH-stabilised by addition of a small amount of phosphoric acid in order to avoid the need for acid addition on the paper machine for pH-control. The properties of the PCC mixture and the reference clay fillers used in the trial are listed in the table below. The paper mill alternates between use of two clays in their normal production.

| Filler: | Reference kaolin clay (European filler grade) | Experimental PCC mixture (Faxe Paper Pigments A/S) |
|---|---|---|
| Brightness ($R_{457}$-ISO %) | 80.7 | 94.1 |
| MPS (μm) | 1.79 | 1.62 |
| BET (m$^2$/g) | 15.4 | 10.8 |

The pulp furnish composition was 75 parts deinked pulp (DIP), 20 parts groundwood (GW) and 5 parts Kraft pulp.

The trial PCC mixture was tested at a constant total filler level with all fresh filler added being PCC. The balance to give the total amount of filler is filler introduced with the DIP (recycled paper). Paper was made in three gram weights: 48, 52 and 56 g/m$^2$. For the sake of simplicity only results for 56 g/m$^2$ are shown. The results at the other gram weights were similar. The properties of the papers resulting from the trial are listed in the table below.

| | Reference | Trial |
|---|---|---|
| Added PCC[1] | 0% | 17% |
| Analysed $CaCO_3$ content[1] | 3.5% | 18.3% |
| Analysed clay content[1] | 32.9% | 17.4% |
| Gram weight | 57 g/m$^2$ | 57 g/m$^2$ |
| Roughness TS (0.5 bar) | 2.4 μm | 2.20 μm |
| Roughness WS (0.5 bar) | 2.65 μm | 2.55 μm |
| Porosity (PPS) | 0.252 μm/Pa · s | 0.367 μm/Pa · s |
| Gloss 75°, TS MD | 32.9% | 31.7% |
| Gloss 75°, WS MD | 26.1% | 29.2% |
| Brightness $R_{457}$-ISO | 66.0% | 66.4% |
| Opacity | 94.1% | 95.6% |

[1]By weight based on the total weight of paper;
TS = topside;
WS = wireside;
MD = machine direction.

The runnability of the paper machine remained good during the two-day trial period and it was possible to increase the production capacity by 1.2%. The Hydrocol™ two component retention system was used on the paper machine. The amount of cationic polymer could be reduced by approx. 20% during the trial as the PCC pigment mixture was easier retained than the reference clay. The pH in the paper machine headbox was 7.6 prior to the trial and it increased only slightly (to 7.7) during the trial.

The paper produced during the trial showed excellent results in full-scale commercial printing. It is remarkable that the paper mill had to totally stop bleaching their DIP in order to keep the brightness within the production specifications. This is a big economic advantage and also environmentally beneficial.

EXAMPLE 6

A number of fillers and filler mixtures were tested in a dynamic sheet former trial.

The fillers were three PCCs from Faxe Paper Pigments A/S, Denmark (a fine rhombohedral PCC, a fine scalenohedmal PCC, and a colloidal PCC), and a kaolin clay from Dorfner. The properties of the fillers used in the trial are listed in the table below.

| Filler | Brightness ($R_{457}$-ISO %) | MPS (μm) | BET (m$^2$/g) |
|---|---|---|---|
| Fine rhombohedral PCC | 94.6 | 0.90 | 7.9 |
| Fine scalenohedral PCC | 95.7 | 2.13 | 9.3 |
| Colloidal PCC | 95.4 | 1.40 | 28.1 |
| Kaolin clay (Dorfner) | 81.7 | 2.02 | 8.4 |

Handsheets were made on a dynamic sheet former from Fibertech AB. The pulp furnish consisted of 50 parts groundwood, 30 parts DIP and 20 parts Kraft pulp. The target filler level was 35% by weight of the total weight of the paper. The results are listed below. The target gram weight of the handsheets was 56 g/m$^2$ (The actual gram weights varied between 53.2 and 58.1 g/m$^2$). Handsheets were made at three target filler levels, which were 30%, 33% and 36% filler by weight based on the total weight of the paper. The paper quality parameters were interpolated to a 35% filler level and the results are listed below.

| | Trial No: | | | | | | |
|---|---|---|---|---|---|---|---|
| | 1 | 2 | 3 | 4 | 5 | 6 | 7 |
| Fine rhombohedral PCC[1] | 100 | 80 | 70 | 50 | | | |
| Fine scalenohedral PCC[1] | | | | | 100 | 80 | 50 |
| Colloidal PCC[1] | | 20 | 30 | 50 | | 20 | |
| Kaolin Clay[1] | | | | | | | 50 |
| Analysed $CaCO_3$ content[2] (%) | 32.5 | 32.9 | 32.3 | 32.7 | 32.9 | 32.8 | 18.8 |
| Analysed clay content[2] (%) | 2.5 | 2.1 | 2.7 | 2.3 | 2.1 | 2.2 | 16.2 |
| Gram weight (g/m$^2$) | 54.2 | 53.9 | 55.0 | 56.1 | 57.0 | 56.5 | 56.9 |
| Roughness TS (1 bar) (μm) | 1.33 | 1.35 | 1.31 | 1.35 | 1.28 | 1.28 | 1.16 |
| Porosity (PPS) (μm/Pa · s) | 0.276 | 0.271 | 0.265 | 0.252 | 0.337 | 0.259 | 0.236 |
| Gloss 75°, TS MD (%) | 32.0 | 35.1 | 37.2 | 40.1 | 39.7 | 40.2 | 46.7 |
| Brightness $R_{457}$-ISO (%) | 70.2 | 69.5 | 68.6 | 67.6 | 68.8 | 67.4 | 66.6 |
| Opacity (%) | 92.7 | 93.0 | 93.8 | 92.9 | 93.5 | 92.9 | 92.7 |

[1]parts by weight,
[2]By weight based on the total weight of paper;
TS = topside;
WS = wireside;
MD = machine direction.

What we claim is:

1. A pigment mixture suitable for paper manufacture and comprising colloidal PCC having a BET surface area of 10-100 m$^2$/g in combination with at least one filler selected from the following pigments: kaolin, calcined kaolin, gypsum, chalk, ground marble, silicate-containing minerals, sulfate-containing minerals, oxide-containing minerals, carbonate-containing minerals, hydroxide-containing minerals, calcium sulfoaluminates, plastic particles and organic pigments, wherein said colloidal PCC comprises aggregates/agglomerates having an equivalent spherical particle size in the range of 0.1-5.0 mm, and wherein said aggregates/agglomerates consist of single crystals having an equivalent spherical particle size of 0.01-0.50 mm.

2. The pigment mixture of claim 1, wherein said colloidal PCC has a BET surface area of 15-50 $m^2/g$.

3. The pigment mixture of claim 2, wherein said colloidal PCC has a BET surface area of 20-30 $m^2/g$.

4. A combination of the pigment mixture of claim 3 and non-colloidal PCC.

5. A combination of the pigment mixture of claim 2 and non-colloidal PCC.

6. The pigment mixture of claim 1, wherein said colloidal PCC comprises aggregates/agglomerates having an equivalent spherical particle size in the range of 0.5-3.0 mm, and wherein said aggregates/agglomerates consist of single crystals having an equivalent spherical particle size of 0.01-0.50 mm.

7. The pigment mixture of claim 6, wherein said colloidal PCC comprises aggregates/agglomerates having an equivalent spherical particle size in the range of 0.2-4.0 mm.

8. The pigment mixture of claim 7, wherein said colloidal PCC comprises aggregates/agglomerates having an equivalent spherical particle size in the range of 0.5-3.0 mm.

9. A combination of the pigment mixture of claim 8 and non-colloidal PCC.

10. A combination of the pigment mixture of claim 7 and non-colloidal PCC.

11. A combination of the pigment mixture of claim 6 and non-colloidal PCC.

12. A combination of the pigment mixture of claim 1 and non-colloidal PCC.

* * * * *